United States Patent [19]

Chaut

[11] Patent Number: 4,858,209

[45] Date of Patent: Aug. 15, 1989

[54] TRANSFIGURATING TIMEPIECES

[76] Inventor: Yaron Chaut, 2615 Travis Rd., Apt. G., Columbus, Ohio 43209

[21] Appl. No.: 222,953

[22] Filed: Jul. 21, 1988

[51] Int. Cl.[4] ..... G04B 19/00

[52] U.S. Cl. ..... 368/223; 368/229

[58] Field of Search ..... 368/223–238, 368/276, 277, 280

[56] References Cited

U.S. PATENT DOCUMENTS

| | | | |
|---|---|---|---|
| D. 256,890 | 9/1980 | Diskin . | |
| D. 258,808 | 4/1981 | Diskin . | |
| 864,533 | 8/1907 | Hadley . | |
| 1,929,582 | 10/1933 | Greenwood . | |
| 3,593,515 | 7/1971 | Shockner et al. . | |
| 3,849,978 | 11/1974 | Davis | 368/223 |
| 3,875,736 | 4/1975 | Gulko . | |
| 4,280,211 | 7/1981 | Mayenschein | 368/223 |
| 4,370,064 | 1/1983 | Hicks et al. | 368/223 |

OTHER PUBLICATIONS

Immanuel Kant, Critique of Pure Reason, Meiklejohn Translation, pp. 48 to 53.

Albert Einstein, Relativity (Crown Publishers, 1961) pp. 9, 10, 91 to 93, 154 and 155.

Richard P. Feynman, Quantum Electrodynamics QED (Princeton University Press, 1985), p. 111.

Advertisement by Natico Originals, Inc. (Oct. 1987) "Museum Clock".

*Primary Examiner*—Bernard Roskoski

*Attorney, Agent, or Firm*—Benoit Law Corporation

[57] ABSTRACT

Time display elements for displaying different units of time in a clock or other timepiece are arranged in a unitary solid geometrical structure having a predetermined symmetry. That symmetry of the unitary solid geometrical structure is periodically broken up by ongoing contortion of the unitary solid geometrical structure itself, and is periodically restored by movement of the time display elements relative to each other in a display of time providing a definitive space-time statement continually.

26 Claims, 7 Drawing Sheets

TRANSFIGURATING TIMEPIECES

The subject invention relates to methods and apparatus for manifesting space and time perceptions in the form of varying space and time phenomena and, more specifically, relates to transfigurating timepieces.

Transfiguration in this respect denotes changes in form or appearance, of which transfiguring is the present participle used as an adjective.

Mankind's first timepiece was the sun, manifesting time on earth from space. Of course, that first timepiece actually was the earth rotating in space relative to the sun. Although mankind did not know that for a long time, it nevertheless evolved various systems and apparatus for measuring and for indicating time.

Eventually, thinkers became aware of the interrelationship of space and time, as may, for instance be seen from Immanuel Kant, CRITIQUE OF PURE REASON, and Albert Einstein, RELATIVITY. In fact space and time came to be recognized as mutually interdependent, with either having no objective significance without the other. The world of quantum mechanics has fortified this recognition, and quantum electrodynamics has carried it to the subatomic level, referring now simply to space-time, as in Richard Feynman's QED (Princeton University Press, 1985).

Considering now man-made timepieces against this universal background and constant evolution of human thought, perception and endeavor, the lack of application of space-time concepts to the outward manifestations of clocks and similar timepieces appears surprising in retrospect.

Granted, every timepiece has to have some spatial manifestation, otherwise it could not be humanly perceived. So, clocks and watches have three-dimensional housings. Analog timepieces have hands rotating on dials and digital timepieces display a succession of digits, sometimes provided endlessly on rotating and rotationally symmetrical objects or carriers. Also, some clocks have pendulums and other speed regulators, as well as driving weights and even decorative devices that somehow move through space at the clock. There also have been artistic structures moving with time. However, a genuine consequential space-time manifestation appears missing from man's agglomeration of timepieces. For example, the clocks using solid geometrical elements according to U.S. Pat. Nos. 864,533, by A. H. Hadley, issued Aug. 27, 1907, and 1,929,582, by A. S. Greenwood, issued Oct. 10, 1933, do not significantly change their three-dimensional configuration with passage of time. The same may be said of a so-called "Museum Clock," by Natico Originals, Inc., in which three concentric rotary disks with semi-spherical elements suggest a kind of planetary action with time.

The continuous cam clock disclosed in U.S. Pat. No. 3,875,736, by A. G. Gulko, issued Apr. 8, 1975, has a vertically moving central cylinder for indicating hours and a rotatable concentric outer cylinder for indicating minutes. Even though the central cylinder rises and falls with time relative to the outer cylinder, the overall configuration of that continuous cam clock remained cylindrical in outward appearance.

U.S. Pat. No. 3,593,515, by J. R. Shockner et al, issued July 20, 1971, disclosed several time-indicating elements, segments or pegs rising and falling with time relative to a flat or a cylindrical clock surface. However, the clock surface itself remained flat or cylindrical irrespective of time.

An interesting clock was disclosed in U.S. Pat. Des. Nos. 256,890 and 258,808, issued, respectively, Sept. 16, 1980 and Apr. 7, 1981, to S. P. Diskin. That clock had time elements or segments arranged inside a transparent cylinder in the form of a helix which appeared to travel concentrically in that cylinder so that successive elements served to indicate time along a surface line or generatrix of the transparent cylinder. That cylinder remained static with time and even the seemingly traveling helix or helices remained helical in configuration throughout time.

SUMMARY OF THE INVENTION

It is a general object of this invention to overcome the above mentioned shortcomings and to meet the needs expressed or implicit hereinabove or in other parts hereof.

It is a germane object of this invention to provide transfigurating timepieces that make a stronger space-time statement than existing timepieces.

It is a related object of this invention to provide timepieces continuously or continually expressing passage of time by periodically breaking up the symmetry of the timepiece.

It is also an object of this invention to provide timepieces expressing time by continually or continuously subdividing common sides of a solid geometrical structure.

Other, aspects will become apparent in the further course of this disclosure.

From one aspect thereof, the subject invention resides in a method of, or apparatus for, displaying time with relatively moving time display elements for displaying different units of time, and, more specifically, resides in the improvement comprising in combination the steps of, or means for, arranging those elements in a unitary solid geometrical structure having a predetermined symmetry, and periodically breaking up that predetermined symmetry by ongoing contortion of the solid geometrical structure itself and periodically restoring said predetermined symmetry by movement of the time display elements relative to each other in a display of time.

From a related aspect thereof, the subject invention resides in apparatus for displaying time, comprising in combination a plurality of segments bearing time markings and arranged in a unitary solid geometrical structure having several distinct sides extending over those segments at a predetermined point of time, and a timepiece drive coupled to those segments for rotating those segments relative to each other to subdivide the mentioned distinct sides into more sides than these several sides at different points of time, while displaying time with the mentioned time markings.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or equivalent parts, and in which.

DESCRIPTION OF PREFERRED EMBODIMENTS

Figure 1:
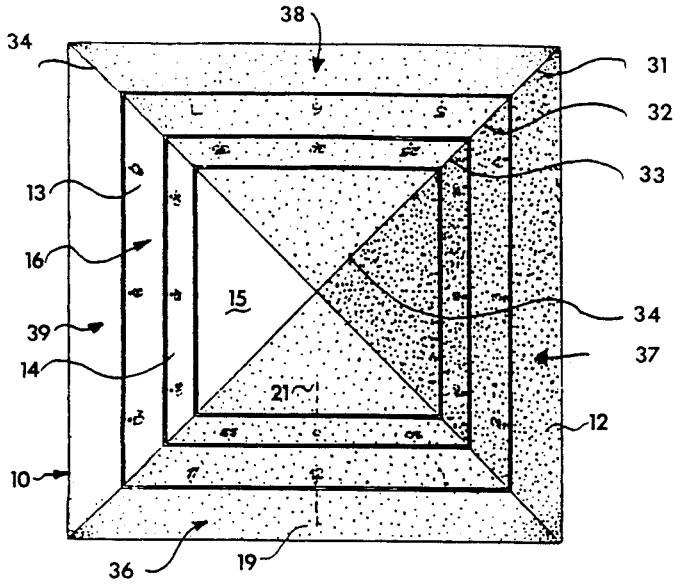
FIG. 1 is a top view of a transfigurating clock according to an embodiment of the subject invention.
Figure 3:
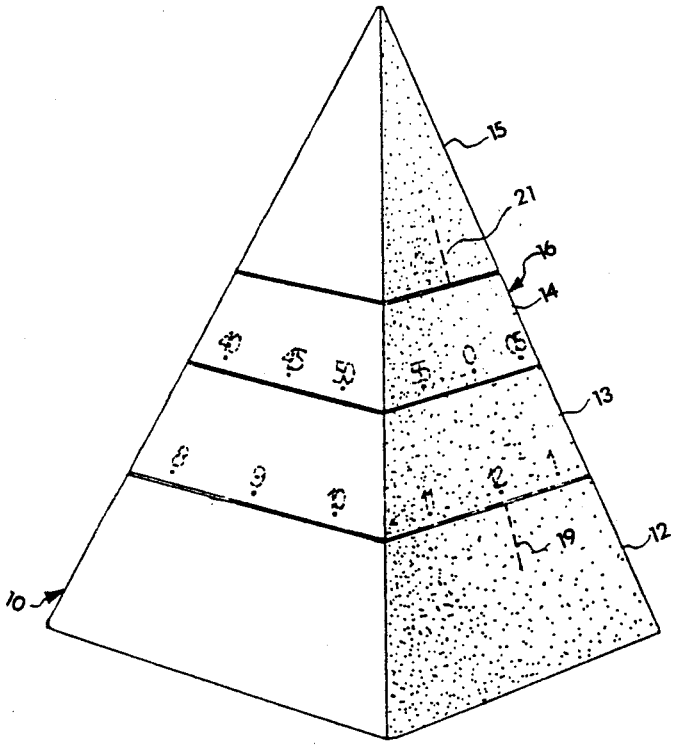
FIG. 3 is a perspective view of the clock shown in FIG. 1 at a certain point of time.
Figure 4:
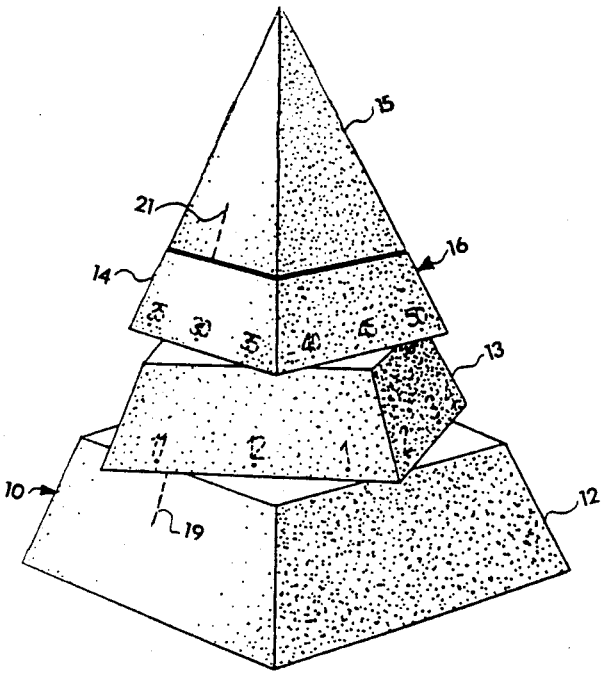
FIG. 4 is a view similar to FIG. 3, but showing the clock as transfigured at a second point of time.
Figure 5:
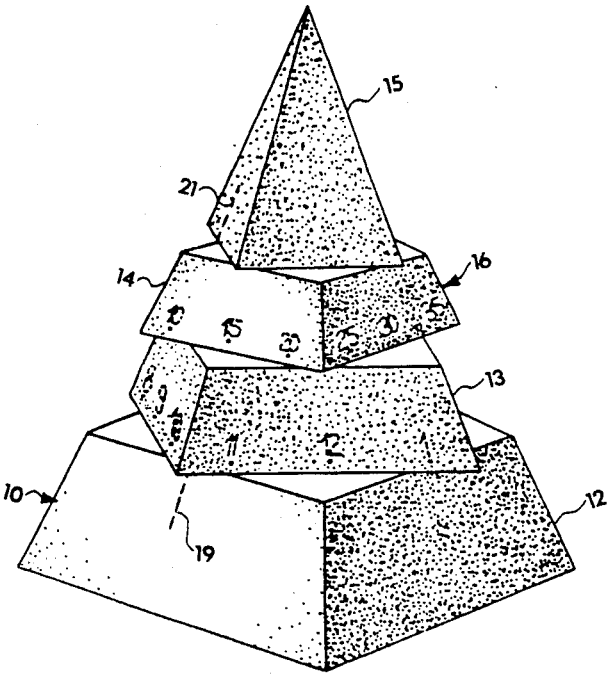
FIG. 5 is another view similar to FIG. 3, but showing te clock as transfigured at a third point of time.

The timepiece or clock 10 shown in FIGS. 1 et seq. comprises relatively movable or moving time display elements 12, 13, 14 and 15 for displaying different units of time, such as hours and minutes, for example. According to the subject invention, these elements are arranged in a unitary solid geometrical structure 16 having a specific configuration as shown by way of example in FIGS. 1 and 3. Also according to the subject invention, the unitary solid geometrical structure 16 is transfigured or transformed in outward appearance from that specific configuration through various three-dimensional outward appearances, such as shown in FIGS. 4 and 5 to the specific configuration shown in FIGS. 1 and 3, by movement of the time display elements 12, 13, 14 and 15 relative to each other or one to another in a display of time. In practice, not all segments or elements 12 to 15 of the apparatus 10 need be movable in point of time. For instance, elements 13 and 14 may be movable relative to each other and both of these elements may also be movable in point of time. The top of the element 15 may be movable, or may be relatively stationary, with the element 16 moving relatively thereto as a function of time. However, at least according to FIG. 5, the top element 15 is also moving as a function of time and thereby enhances the spatial transformation or transfigurating effect achieved by embodiments of the subject invention.

On the other hand, the bottom element 12 may be a stationary or relatively stationary base of the clock 10, and occasionally will be designated as such hereinafter.

The structure 16 is solid geometrical, with solid geometry being that branch of geometry which deals with figures of three-dimensional space. Of course, the adjective solid geometrical would also refer to such three-dimensional figures as spheres, stepped or continuous circular cylinders and cones. Such figures may be designated as rotationally symmetrical, since they or their elements with their outer surfaces extend symmetrically about an axis of rotation through the center of the sphere or along the height of the circular cylinder or cone.

By way of background, a good example of a rotationally symmetrical structure is an odometer composed of circularly cylindrical elements arranged side by side or on top of each other, depending on orientation. Such a structure, would, however, not be suitable for an implementation of the subject invention as its rotationally symmetrical configuration would prohibit a transformation of the unitary solid geometrical structure through various three-dimensional outward appearances in a display of time.

To avoid that deficiency, the preferred embodiment of the subject invention shapes and arranges the time display elements 12 to 15 into a non-circular configuration as the desired specific configuration of the unitary solid geometrical structure 16. Such time display elements are then moved relatively to each other to transform the non-circular configuration through different outward appearances while displaying time with such moving time display elements.

Expressed differently within the scope of the subject invention, the apparatus 10 comprises, in combination, a plurality of non-circular segments 12, 13, 14 and 15 arranged in a unitary solid geometrical structure 16 and bearing time markings as shown in FIGS. 1, 3, 4 and 5, for instance.

A timepiece drive 18, more fully described below, is coupled to these segments for rotating such segments relative to each other to transform a three-dimensional outward appearance of the unitary solid geometrical structure 16 through various outward manifestations while displaying time with the time markings, as shown in FIGS. 1, 3, 4 and 5, for instance.

Figure 2:
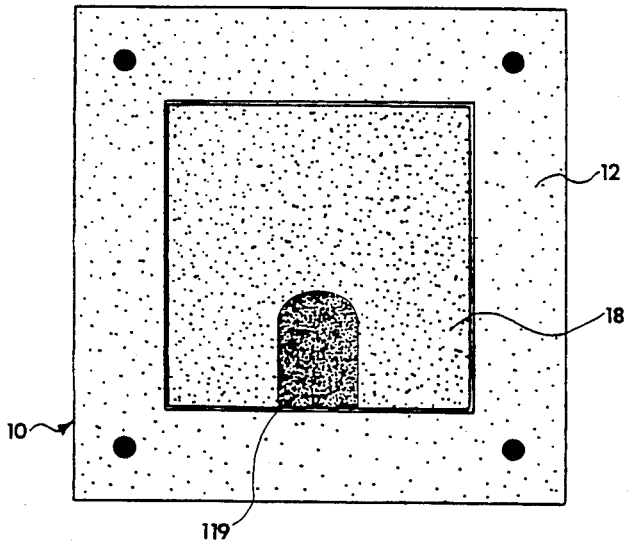
FIG. 2 is a bottom view of the clock shown in FIG. 1.

The timepiece drive 18 is symbolically shown in FIG. 2 as inserted into the bottom of the clock. By way of example, at least the base or bottom element 12 may be hollow for that purpose, and what is seen in FIG. 2 may be a base for the timepiece drive 18 with or without a removable lid 119 for an electric power source, such as one or more batteries, unless a mechanical drive or an electric drive operating from a power outlet is preferred. Indeed, all kinds of drives for the movable elements may be employed in the practice of the subject invention, and the expression timepiece drive as herein employed is intended to be sufficiently broad to cover such drives, including clock actions, clockworks, and the like, without being limited thereto.

Within the scope of the subject invention, the unitary solid geometrical structure has several distinct sides extending over the elements or segments 12 to 15 at a predetermined point of time. By way of example, FIGS. 1 and 3 show a four-sided pyramid which, accordingly, has four lateral sides extending from the top to the bottom of the pyramid over the mutually aligned time display elements or segments 15, 14, 13 and 12. Strictly speaking, the illustrated pyramid also has a fifth side at the bottom shown in FIG. 2, but only the four lateral sides are rendered variable in the illustrated embodiment.

These four lateral sides extend over the time display elements or segments at one or more predetermined times, such as at 3 AM, 6 AM, 9 AM, 12 noon, 3 PM, 6 PM, 9 PM, and at midnight in the embodiment as shown in FIGS. 1 and 3.

The illustrated preferred embodiments then break up the original sides into more sides than such original sides of the solid geometrical structure by movement of the time display elements or segments relative to each other in a display of time. For instance, the embodiment shown in FIGS. 1 et seq. subdivides the four lateral sides shown in FIGS. 1 and 3 into more sides than such four original sides by movement of the time display elements or segments 15, 14, 13 and 12 relative to each other in a display of time. For example, six differently arranged sides are visible in FIG. 4, if the visible sides of the top elements 14 and 15 are counted as two sides, since such top elements are mutually aligned. If the sides not visible in FIG. 4 are added to the visible sides, it is seen that the configuration at the point of time shown in FIG. 4 has twelve sides, as contrasted with the only four sides seen in FIG. 1.

Moreover, sixteen lateral sides are either facing the observer or facing away from the observer in the representation of FIG. 5 at a further point of time different from the point of time indicated in FIGS. 1 and 3 and from the other point of time indicated in FIG. 4. Indeed, with a four-sided pyramid a sixteen-sided configuration is readily attainable from time to time by shifting each time display element or segment out of alignment with its neighboring time display element or segment.

If the pyramid were three-sided, then its major sides could be broken up as a function of time into as many as twelve distinct sides, unless more than four time display elements or segments were used. By way of example, there could be a further time display element in each case in order to display seconds, and even one or more further elements in order to display days of the week, days of the month, names of the month, etc. In this respect and in general, time pieces according to embodiments of the subject invention may include or may in fact constitute calendars.

A preferred embodiment of the subject invention recurringly transforms the unitary solid geometrical structure, such as the pyramid 16, to its specific configuration, such as to the original configuration shown in FIGS. 1 and 3, via various three-dimensional outward appearances, such as including those shown in FIGS. 4 and 5. By way of example, the unitary solid geometrical structure 16 may be periodically transformed to the specific configuration shown in FIGS. 1 and 3, for instance, via various three-dimensional outward appearances as a function of time, such as illustrated in FIGS. 4 and 5. In this respect, FIG. 4 shows the time index 19 at the bottom element, segment or base 12 in effect between the hours of 10 and 11 on the rotating hour element or segment 13, if the perspective of FIG. 4 is considered. FIG. 4 also shows the indication of half an hour or thirty minutes on the rotating minute element or segment 14 aligned with the time index 19. FIG. 4 may thus be taken as showing the time of 11:30. An AM or PM indication may, if desired be added to this time indication, such as by the addition of yet another rotating time element or segment, or the clock may be designed as a twenty-four hour clock, such as by digits to this effect on the rotating hour element 13.

To a person familiar therewith, the clock 10 would also indicate spatially that another quarter hour has passed, such as from the spatial alignment of the base and minute elements or segments 12 and 14 as in FIGS. 4 and 5. This thus spatially expresses an ancient human division of time, which for centuries was manifested aurally by striking a clock or bell every quarter hour.

As seen in FIG. 5, the pyramid top 15 may also bemoved or rotated, such as to indicate seconds. In the illustrated simplified version, an index or marking 21 may be provided on the top 15 to aid the observer with a spatial impression of advancing time.

FIGS. 1 and 3 illustrate restoration of a specific configuration within predetermined units of time, such as every three hours, or every hour on the hour, or every fifteen minutes, etc.

Within the scope of the subject invention, part of the specific configuration may be restored within one of predetermined different units of time. For instance, if a pyramid or prism is four-sided, then a specific part 14 of the pyramid 16 may be restored to coincidence with the base 12 every fifteen minutes or quarter hour, as in FIGS. 4 and 5.

Another part of the specific configuration may then be restored within another of predetermined different units of time. For instance, as apparent from FIGS. 1 and 3, the relatively moving base and hour elements of the four-sided pyramid 16 are readily restored to coincidence every three hours. This rate of occurrence may, of course, be varied within the scope of the subject invention by using differently sided prisms, pyramids, parallelepipeds, cubes, etc.

In this respect and in general, it is to be kept in mind that the adjective "solid" in such expressions as solid geometry and solid geometrical as herein employed refers to that branch of geometry dealing with the figures of three-dimensional space. That meaning of "solid" of course neither excludes, nor is it intended herein to exclude, the presence of any cavity in the base 12, as indicated in FIG. 2, or in any other part of any structure, and/or the presence of apertures in the solid geometrical structure 16 or in any other structure transfigured or time-transformed according to the subject invention. Indeed, the top 15 or any other part of any such structure may, for instance, be made of wire mesh, apertured sheet material, etc.

Figure 6:
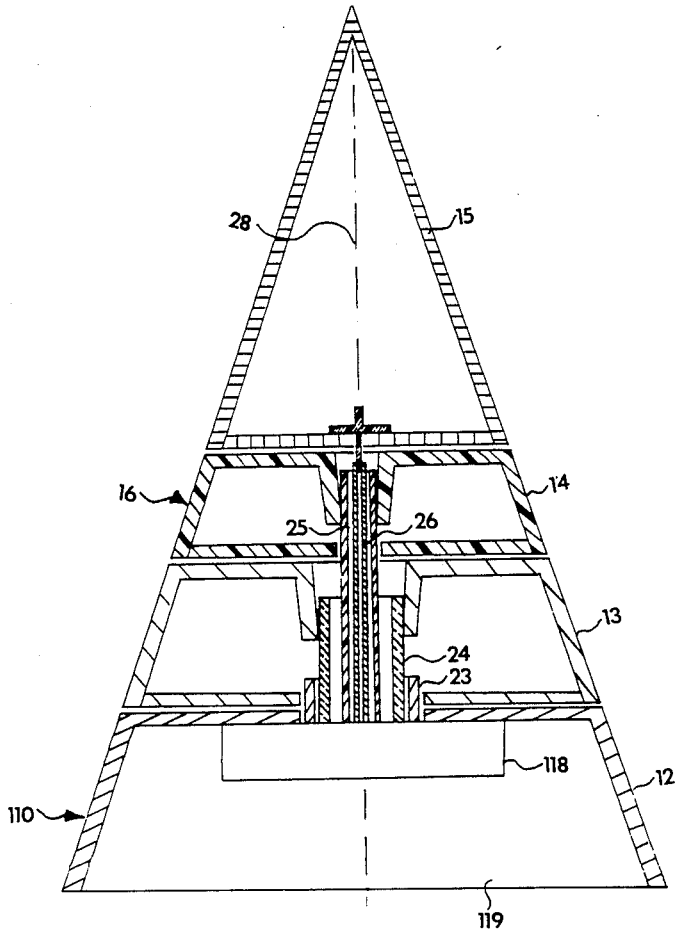
FIG. 6 is a side view, partially in section, of a transfigurating clock similar to the clock shown in FIGS. 1 to 5 according to a single-axis embodiment of the subject invention.

The timepiece or clock 110 shown in FIG. 6 also serves the continuous or continual expression of passage of time by change of form or appearance. Such timepiece or clock according to FIG. 6 may be similar or even identical to the timepiece or clock 10 shown in FIGS. 1 to 5. However, FIG. 6 shows an open bottom 119 and a clockwork 118 as the timepiece drive, which may also be used as such in the embodiment of FIGS. 1 to 5. The power source symbolized at 19 in FIG. 2 and otherwise described above has not been shown in FIG. 6.

The clockwork 118 has a base or housing attached to the base 12, such as with the aid of a thread 23. The driven part of the clockwork has an outer hollow shaft 24, an inner hollow shaft 25 and a central solid shaft 26, all arranged concentrically, for driving the hour, minute and second segments, respectively, as if they were hands of a regular analog clock. Accordingly, the outer hollow shaft has an end attached to the hour segment or element 13. The inner hollow shaft 25 has an end attached to the minute segment or element 14, and the central solid shaft 26 has an end attached to the top segment or element 15 for indicating the passage of seconds in time and space.

As specifically illustrated in FIG. 6, at least the time segments or elements 13, 14 and 15 are arranged along an axis 28 and such segments or elements are made asymmetrical relative to that axis, rather than rotationally symmetrical. Accordingly, the outward appearance of the unitary solid geometrical structure is again transformed as the clockwork 118 moves the asymmetrical time segments or elements 13, 14 and 15 relative to each other and to the bottom element or base 12 about the axis 28 in a display of time. What has been said above with respect to FIGS. 1 to 5 may also be applied to the embodiment shown in FIG. 6 in which the unitary solid geometrical structure is also in the form of a pyramid 16. However, the subject invention and its embodiments are not limited in any such manner.

Figure 7:
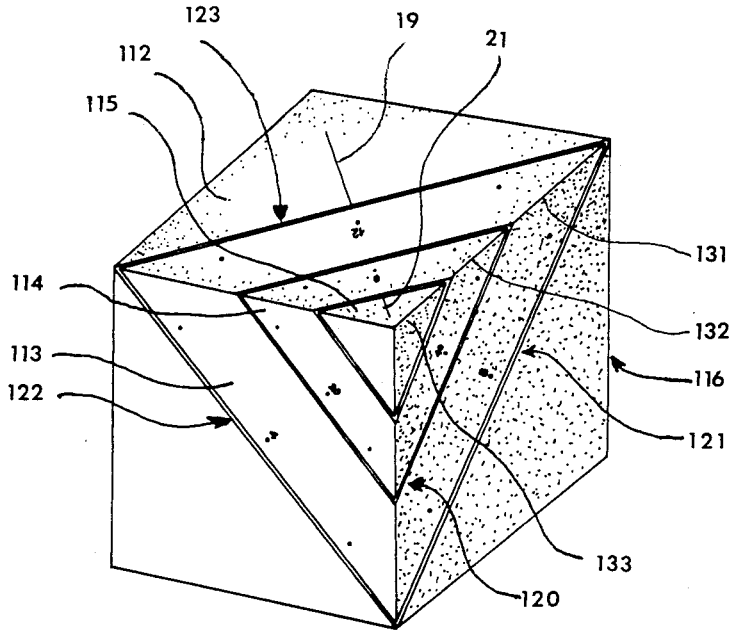
FIG. 7 is a perspective view of a transfigurating clock according to a further embodiment of the subject invention.
Figure 8:
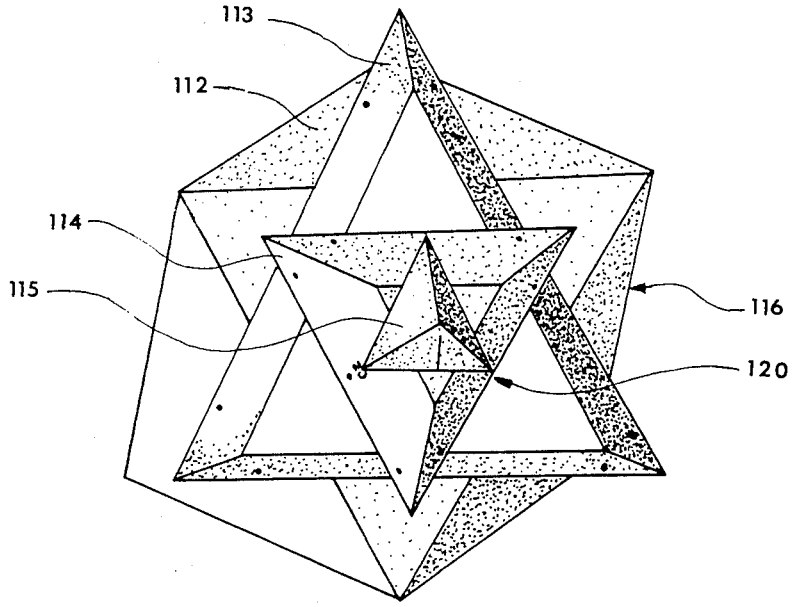
FIG. 8 is a perspective view of the clock of FIG. 7, at a point of time different from the point of time displayed in FIG. 7.

By way of further example, FIGS. 7 and 8 illustrate a unitary solid geometrical structure 116 in the form of a cube or parallelepiped which in some manner has its outward appearance transformed from the specific basic configuration shown in FIG. 7 through various three-dimensional outward appearances back to that specific configuration by movement of time display elements 113, 114 and 115 relative to each other and to the main body 112 of the parallelepipedal configuration in a display of time.

By way of example rather than by way of limitation, the same clockwork as shown at 118 in FIG. 6 may be employed in the parallelepipedal embodiment for driving the hour, minute and second segments or elements 113, 114 and 115 through concentric shafts 24, 25 and 26, respectively.

The unitary solid geometrical structure 116 of the embodiment shown in FIGS. 7 and 8 has a corner 120 having distinct sides, including several sides 121, 122 and 123 on three sides of the corner 120. That corner is subdivided into segments 113, 114 and 115 extending over these several sides 113, 114 and 115 bearing time markings. In fact, what is now a base 112 may also be considered as one of the segments extending over the three sides of the corner 120.

A timepiece drive, such as the above mentioned clockwork 118 shown in FIGS. 6, now mounted in the base 112, is coupled to the segments 113, 114 and 115 for rotating these segments relative to each other and to the base segment 112. As seen in FIG. 8, this subdivides the distinct sides 121, 122 and 123 into more sides than these three sides at different points of time, while displaying time with the time markings on the rotating segments or time elements. Of course, within the scope of the embodiment illustrated in FIGS. 7 and 8, there may be as many different appearances as in the case of the pyramid clock disclosed above with the aid of FIGS. 1 to 6, except that the pyramid is now three sided or is a corner of a cube, parallelepiped, prism or the like.

Figure 9:
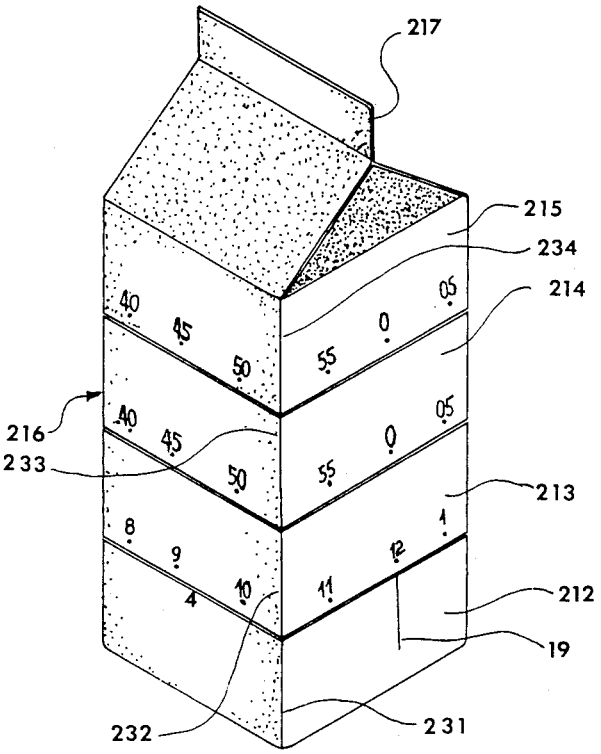
FIG. 9 is a perspective view of a transfigurating clock in the form of a typical consumer item and according to a further embodiment of the invention.
Figure 10:
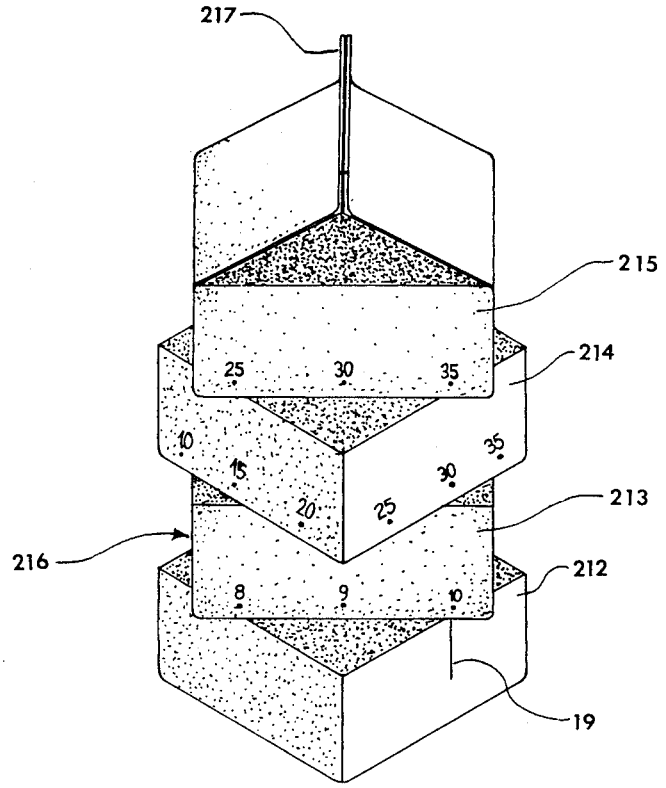
FIG. 10 is a perspective view of the clock of FIG. 9, at a point of time different from the point of time displayed in FIG. 9.

FIGS. 9 and 10 show a transfigurating clock according to an embodiment of the subject invention in the form of a consumer item represented as a solid geometrical structure 216, subdivided into segments 212, 213, 214 and 215. The segment 212 may again be a base having a timepiece drive, such as the clockwork 118 shown in FIG. 6, mounted therein for movement or rotation of the segments 213, 214 and 215 relative to each other. The segment 213 may indicate hours, the segment 214 may indicate minutes, and the segment 215 may indicate seconds by rotation thereof. The top segment 215 represents the top seal 217 of a milk carton. In most countries, a milk carton is a well-recognized consumer item. Typically, such milk cartons contain milk, another well-known consumer item. However, such "milk cartons" now also contain various juices and similar consumer items for convenient delivery to and consumption by a multitude of consumers.

FIG. 9 shows the illustrated consumer item in its typical solid geometrical form. By way of example, this form may be represented by the transfigurating clock every three hours on the hour, if the base of the solid geometrical structure is a square. Different time intervals for a unitary showing may, however, be provided, such as by making the base of the unitary structure rectangular, for instance.

The transfigurating clock shown in FIGS. 9 and 10 again displays a strong space-time statement to the observer by moving the segments 213, 214 and 215 relative to each other and to the base element 212, such as in the manner shown in FIG. 10. In the case of a well-known consumer item, such space-time statement is particularly strong, since such consumer item is well recognized by large if not all segments of the population, as in the case of the example shown in FIG. 9, whereby any deviation from such form, including the deviation shown in FIG. 10, makes a particularly strong impression on the observer.

Within the scope of the subject invention, consumer items include consumer goods, a dictionary definition of which is "economic goods that directly satisfy human wants or desires." Also included within the scope of the subject invention are regular containers for consumer goods, as well as all kind of knickknack or other objects produced in large quantities as souvenirs for "consumption" by tourists and the general public as mementoes or decorative items. While some may reach the point of disputing taste as to some of these items, the fact of the matter is that such well-recognized objects make a particularly strong space-time statement when distorted from their customary shape as a function of time and when periodically restored to their customary form at particular points of time.

The illustrated, as well as other conceivable embodiments within the scope of the subject invention, have several features and their combination in common, despite different appearances and manifestations. For instance, all time elements 12 to 15, 112 to 115 and 212 to 215 are arranged in a unitary solid geometrical structure 16, 116 or 216, having a predetermined symmetry. Symmetry in this respect includes a correspondence in relative position of parts, a correspondence in form and arrangement of parts, a geometrical or other spatial regularity or a unified system of subordinate parts. Specific examples of symmetry within the scope of the subject invention are seen in FIGS. 1, 3, 7 and 9. However, some symmetry is also apparent from the coincidence of segments 14 and 15 in FIG. 4, segments 13 and 15 in FIG. 5, or segments 12 and 14 in that FIG. 5, segments 113 and 115 in FIG. 8, segments 212 and 214 in FIG. 10 and segments 213 and 215 in that FIG. 10.

The subject invention periodically breaks up that predetermined symmetry by ongoing contortion of the unitary solid geometrical structure itself, such as shown with respect to the hour element 13 relative to the elements 12, 14 and 15 in FIG. 4, or the adjacent elements 12 and 13, 13 and 14, and 14 and 15 according to FIG. 5, or the elements or segments according to FIG. 8 and FIG. 10, respectively.

The predetermined symmetry of the unitary solid geometrical structure, such as shown in FIGS. 1, 3, 7 and 9, is periodically restored. All this is done by movement of the time display elements relative to each other in a display of time.

According to a preferred embodiment of the invention, the unitary solid geometrical structure is contorted through various three-dimensional outward appearances between successive restorations of the unitary solid geometrical structure in a display of time. By way of example, FIGS. 4 and 5 illustrate two different three-dimensional outward appearances of the transfigurating clock between successive restorations of the unitary solid geometrical structure 16 as shown in FIGS. 1 and 3. Of course, the transfigurating clocks according to the illustrated embodiments of the invention would go through more different three-dimensional outward appearances between restorations to the unitary solid geometrical structure shown in FIGS. 1, 3 and 6, FIG. 7, or FIG. 9, than the specific examples of contortion according to FIGS. 4, 5, 8 and 10, respectively.

Where the unitary solid geometrical structure has a predetermined envelope volume, as in FIGS. 1, 3, 6, 7 and 9, that predetermined envelope volume is preserved throughout the ongoing contortion of the solid geometrical structure. By way of example, the envelope volume of the solid geometrical structure shown in FIGS. 1 to 6 is constant throughout the contortions of FIGS. 4 and 5. The same applies to the embodiment of FIGS. 7 and 8, where the envelope volume is constant whether the segments are positioned as shown in FIG. 7 or as shown in FIG. 8. Similarly, the envelope volume of the segments 212 to 215 is the same in FIGS. 9 and 10.

The predetermined symmetry of the solid geometrical structure is restored within predetermined units of time, as mentioned above and as shown in FIGS. 1, 3, 6, 7 and 9, for instance. Within the scope of the subject invention part of the symmetry of a unitary solid geometrical structure may be restored from time to time.

By way of example, FIG. 4 shows restoration of a symmetry of part of the unitary solid geometrical structure within one of the different units of time, such as by bringing the second segment 15 into periodic coincidence with the minute segment 14. A further symmetry of another part of the unitary solid geometrical structure may be restored within another of the different units of time, such as by aligning the minute segment 14 with the base 12, as in FIG. 4 or FIG. 5, or by aligning the second segment 15 with the hour segment 13, as in FIG. 5. Similar periodic partial restorations of symmetry may be effected with the embodiments of FIGS. 7 to 10, such as shown for the base and minute elements 112 and 114 or 212 and 214, and for the hour and second elements 113 and 115 or 213 and 215, in FIGS. 8 and 10.

As explained above with the aid of FIGS. 2 and 6, the means for periodically breaking up and restoring the predetermined symmetry of a unitary solid geometrical structure include a timepiece drive 18 or clockwork 118 coupled to the time display elements or segments for displaying different units of time by rotation of such time display elements or segments relative to each other, such as shown in the drawings.

Means may thus be coupled to the timepiece drive and time display elements for the contortions and restorations of the unitary solid geometrical structure according to the accompanying drawings.

Where the time display elements extend along a common axis 28, the means for periodically breaking up and restoring the predetermined symmetry of the unitary solid geometrical structure include means, such as the shafts 24, 25 and 26, coupled to the timepiece drive and the time display elements for rotating such time display elements relative to each other about that common axis in a display of time. More generally, where the time display elements are arranged along an axis, a periodic breakup of the predetermined symmetry and an ongoing contortion of the unitary solid geometrical structure may be effected by rotating the time display elements relative to each other about the axis in a display of time.

Where the time display elements are provided with corners, such as shown at 31, 32, 33 and 34 in FIG. 1, or at 131, 132 and 133 in FIG. 7, or at 231, 232, 233 and 234 in FIG. 9, a predetermined symmetry is periodically restored by mutually aligning corresponding corners of the time display elements by movement of such time display elements relative to each other. Conversely, such predetermined symmetry is periodically broken up and an ongoing contortion of the unitary solid geometrical structure is effected by moving the corresponding corners out of alignment with each other by movement of the time display elements relative to each other in a display of time, such as illustrated in FIGS. 4, 5, 8 and 10.

The solid geometrical structures shown in the drawings have or are provided with several sides extending over the time elements or segments at a predetermined point of time. Thus, FIG. 1 shows for the four-sided pyramid 16 the four lateral sides 36, 37, 38 and 39, each extending over the time elements or segments 12 to 15 at 12:00 hours and at exactly every three hours thereafter.

Similarly, FIG. 7 shows for a three-sided pyramid or corner 120 the three sides 121, 122 and 123 extending over these time elements including corner segments 113, 114 and 115 at 12:00 hours and at exactly every four hours there after.

One may also easily conclude from FIG. 9 that the lateral sides of the solid geometrical structure or parallelepiped 216 extend over the time elements or segments 212 to 215 at the points of time illustrated by FIG. 9.

However, according to the embodiment of the invention illustrated by way of example in the drawings, the sides 36, 37, 38 and 39, the sides 121, 122 and 123 and the corresponding sides in the embodiment of FIG. 9 are broken up or subdivided into more sides than the four basic sides according to FIG. 1, the mentioned three sides according to FIG. 7 and the mentioned four sides according to FIG. 9, by movement of the time display elements relative to each other in a display of time, as shown in FIGS. 4, 5, 8 and 10, for example.

In the illustrated embodiments of the invention, it is the timepiece drive 18 or clockwork 118 which is coupled to the time element or segments for rotating these time elements or segments 12 to 15, 112 to 115 and 212 to 215 relative to each other to subdivide the distinct basic sides into more sides than such several basic sides at different points of time, while displaying time with the time markings thereon. This again provides a very strong space-time statement to the observer.

In the 1970's the digital watch almost drove the analog watch industry out of business. However, the analog watch has come back very strongly when people realized that a mere digit display simply cannot give them the kind of relationship to the day which an analog watch provides by the spatial position of its hands relative to the time markings of the watch dial. The transfigurating clocks according to the subject invention carry that principle further into the kind of space-time interrelationship recognized by modern physics as controlling our earthly perception.

Moreover, the subject extensive disclosure will render apparent or suggest to those skilled in the art various modifications and variations within the spirit and scope of the invention and equivalents thereof.

I claim:

1. A method of displaying time with relatively moving time display elements for displaying different units of time, comprising in combination the steps of:

arranging said elements in a unitary solid geometrical structure having a predetermined symmetry; and periodically breaking up said predetermined symmetry by ongoing contortion of said unitary solid geometrical structure itself and periodically restoring said predetermined symmetry by movement of said time display elements relative to each other in a display of time.

2. A method as claimed in claim 1, wherein:

said unitary solid geometrical structure is contorted through various three-dimensional outward appearances between successive restorations of said unitary solid geometrical structure in a display of time.

3. A method as claimed in claim 1, wherein:

said unitary solid geometrical structure is provided with a predetermined envelope volume; and said predetermined envelope volume is preserved throughout said ongoing contortion.

4. A method as claimed in claim 1, including the step of:

restoring said predetermined symmetry within predetermined units of time.

5. A method as claimed in claim 1, including the step of:

restoring a symmetry of part of said unitary solid geometrical structure within one of said different units of time.

6. A method as claimed in claim 1, including the step of:

restoring a further symmetry of another part of said unitary solid geometrical structure within another of said different units of time.

7. A method as claimed in claim 1, including the steps of:

providing said time display elements with corners;

restoring said predetermined symmetry by mutually aligning corresponding corners of said time display elements by movement of said time display elements relative to each other; and periodically breaking up said predetermined symmetry and effecting said ongoing contortion by moving said corresponding corners out of alignment with each other by movement of said time display elements relative to each other in a display of time.

8. A method as claimed in claim 1, including the steps of:

providing said unitary solid geometrical structure with several sides extending over said time display elements at a predetermined time; and subdividing said sides into more sides than said several sides by movement of said time display elements relative to each other in a display of time.

9. A method as claimed in claim 1, including the steps of:

arranging said time display elements along an axis;

periodically breaking up said predetermined symmetry and effecting said ongoing contortion of said unitary solid geometrical structure by rotating said time display elements relative to each other about said axis in a display of time.

10. A method as claimed in claim 1, including the steps of:

providing said unitary solid geometrical structure in the form of a consumer item having said predetermined symmetry;

subdividing said unitary solid geometrical structure into segments;

using said segments as time display elements; and moving said segments relative to each other to transform a three-dimensional outward appearance of said consumer item through various three-dimensional outward appearances back to said outward appearance of said consumer item in a display of time.

11. In apparatus for displaying time with relatively moving time display elements for displaying different units of time, the improvement comprising in combination:

an arrangement of said elements in a unitary solid geometrical structure having a predetermined symmetry; and means for periodically breaking up said predetermined symmetry by ongoing contortion of said unitary solid geometrical structure itself and for periodically restoring said predetermined symmetry, including means for moving said time display elements relative to each other in a display of time.

12. Apparatus as claimed in claim 11, wherein:

said unitary solid geometrical structure has a constant envelope volume throughout said ongoing contortion.

13. Apparatus as claimed in claim 11, wherein:

said means for periodically breaking up and restoring said predetermined symmetry include a timepiece drive coupled to said time display elements for displaying different units of time by rotation of said time display elements relative to each other.

14. Apparatus as claimed in claim 13, wherein:

said means for periodically breaking up and restoring said predetermined symmetry include means coupled to said timepiece drive and said time display elements for recurringly contorting said unitary solid geometrical structure through various three-dimensional outward appearances between successive restorations of said unitary solid geometrical structure in a display of time.

15. Apparatus as claimed in claim 13, wherein:

said means for periodically breaking up and restoring said predetermined symmetry include means coupled to said timepiece drive and said time display elements for restoring said predetermined symmetry within predetermined units of time.

16. Apparatus as claimed in claim 13, wherein:

said arrangement of said time display elements extends along a common axis;

said means for periodically breaking up and restoring said predetermined symmetry include means coupled to said timepiece drive and said time display elements for rotating said time display elements relative to each other about said common axis in a display of time.

17. Apparatus as claimed in claim 13, wherein:

said time display elements have corners;

said means for periodically breaking up and restoring said predetermined symmetry include means coupled to said timepiece drive and to said time display elements for rotating said time display elements into periodic alignment of corresponding corners of said time display elements and into deliberate misalignment of corresponding corners between successive alignments in a display of time.

18. Apparatus as claimed in claim 11, wherein:

said unitary solid geometrical structure is in the form of a consumer item broken down into segments constituting said time display elements and having said predetermined symmetry; and said means for periodically breaking up and restoring said predetermined symmetry include means for moving said segments relative to each other in a display of time.

19. Apparatus for displaying time, comprising in combination:

a plurality of segments bearing time markings and arranged in a unitary solid geometrical structure having several distinct sides extending over said segments at a predetermined point of time; and a timepiece drive coupled to said segments for rotating said segments relative to each other to subdivide said distinct sides into more sides than said several sides at different points of time, while displaying time with said time markings.

20. Apparatus as claimed in claim 19, wherein said unitary solid geometrical structure is in the form of a pyramid.

21. Apparatus as claimed in claim 19, wherein:

said unitary solid geometrical structure is in the form of a parallelepiped.

22. Apparatus as claimed in claim 19, wherein:

said solid geometrical structure has a corner having several sides as said distinct sides; and said corner is subdivided into said segments extending over the latter several sides and bearing said time markings.

23. A method as claimed in claim 1, wherein:

said elements are arranged in the form of a pyramid as said unitary solid geometrical structure; and a predetermined symmetry of said pyramid is periodically broken up by ongoing contortion of said pyramid itself.

24. A method as claimed in claim 1, wherein:

said elements are arranged in the form of a parallelepiped as said unitary solid geometricl structure; and a predetermined symmetry of said parallelepiped is periodically broken up by ongoing contortion of said parallelepiped.

25. Apparatus as claimed in claim 11, wherein:

said unitary solid geometrical structure is in the form of a pyramid.

26. Apparatus as claimed in claim 11, wherein:

said unitary solid geometry structure is in the form of a parallelepiped.

* * * * *